US009138986B2

(12) United States Patent
Houben

(10) Patent No.: US 9,138,986 B2
(45) Date of Patent: Sep. 22, 2015

(54) CONSTANT FLOW HIGH PRESSURE PRINTING SYSTEM

(75) Inventor: Rene Jos Houben, Nederweert (NL)

(73) Assignee: NEDERLANDSE ORGANISATIE VOOR TOEGEPAST-NATUURWETENSCHAPPELIJK ONDERZOEK TNO, Delft (NL)

( * ) Notice: Subject to any disclaimer, the term of this patent is extended or adjusted under 35 U.S.C. 154(b) by 1000 days.

(21) Appl. No.: 12/514,759

(22) PCT Filed: Nov. 14, 2007

(86) PCT No.: PCT/NL2007/050563

§ 371 (c)(1),
(2), (4) Date: Aug. 21, 2009

(87) PCT Pub. No.: WO2008/060149

PCT Pub. Date: May 22, 2008

(65) Prior Publication Data

US 2010/0013886 A1 Jan. 21, 2010

(30) Foreign Application Priority Data

Nov. 14, 2006 (EP) ..... 06077011

(51) Int. Cl.
*B41J 2/015* (2006.01)
*B41J 2/02* (2006.01)

(52) U.S. Cl.
CPC ..... *B41J 2/02* (2013.01)

(58) Field of Classification Search
USPC ..... 347/19–20, 73
See application file for complete search history.

(56) References Cited

U.S. PATENT DOCUMENTS

| | | | | |
|---|---|---|---|---|
| 5,491,499 | A * | 2/1996 | Bibbe et al. | 347/47 |
| 6,494,797 | B1 * | 12/2002 | Homm et al. | 474/18 |
| 6,640,830 | B2 * | 11/2003 | Zahe | 137/491 |
| 6,901,912 | B1 * | 6/2005 | Onishi et al. | 123/456 |
| 7,152,583 | B2 * | 12/2006 | Abe et al. | 123/446 |
| 7,467,642 | B2 * | 12/2008 | Prinsen et al. | 137/491 |
| 8,522,670 | B2 * | 9/2013 | Tonelli et al. | 99/300 |
| 2003/0219346 | A1 * | 11/2003 | Abe et al. | 417/307 |
| 2006/0082746 | A1 * | 4/2006 | Mertens et al. | 355/53 |
| 2006/0164469 | A1 * | 7/2006 | Houben | 347/73 |
| 2006/0201554 | A1 * | 9/2006 | Prinsen et al. | 137/491 |
| 2009/0151573 | A1 * | 6/2009 | Tonelli et al. | 99/280 |
| 2010/0013886 | A1 * | 1/2010 | Houben | 347/17 |

FOREIGN PATENT DOCUMENTS

| | | |
|---|---|---|
| JP | 04-502891 A | 5/1992 |
| JP | 05-066336 | 3/1993 |
| JP | 2005-119031 | 5/2005 |

(Continued)

OTHER PUBLICATIONS

International Search Report for PCT/NL2007/050563, dated Feb. 1, 2008.

*Primary Examiner* — Jason Uhlenhake
(74) *Attorney, Agent, or Firm* — Leydig, Voit & Mayer, Ltd.

(57) ABSTRACT

A high pressure printing system comprising: a high pressure printing head, constructed and arranged for printing a printing fluid with a printing pressure in at least a part of a channel upstream of the printing head in an interval of 15-3000 bars; a pressure system comprising a printing fluid inlet and a plurality of pressure cylinders constructed and arranged for providing a constant flow of said printing fluid, the pressure cylinders being interconnected by at least a pressure valve; and a damper, connected between an outlet of the pressure system and said high pressure printing head, provided for damping the valve action of the pressure valve.

10 Claims, 2 Drawing Sheets

(56) References Cited

FOREIGN PATENT DOCUMENTS

| | | | |
|---|---|---|---|
| JP | 2006-284556 | | 10/2006 |
| WO | WO 90/08038 | | 7/1990 |
| WO | WO 2004/018212 | A | 3/2004 |
| WO | WO 2006/006380 | A1 | 1/2006 |
| WO | WO 2007/039078 | A | 4/2007 |

* cited by examiner

CONSTANT FLOW HIGH PRESSURE PRINTING SYSTEM

FIELD OF THE INVENTION

The invention relates to a high pressure printing system, for example, of the kind disclosed in EP1545884.

BACKGROUND

By virtue of high pressure, it is possible to print fluids having a particularly high viscosity such as, for instance, viscous fluids having a viscosity of 500.10-3 Pa·s when being processed. Possible new substances are, for instance, viscous polymers such as UV-curing polymers which may or may not be provided with fillers such as ceramic and particular pigments. With the apparatus according to the invention, such viscous substances can be used for, for instance, printing three-dimensional objects according to a rapid prototyping approach. Also light-emitting polymers and dispersions (water with particles therein; slurries, etc.) can be printed continuously with such an embodiment. It is now also possible for dispersions with a filling degree of 10-40 weight percent to be printed continuously. Other applications may include providing a droplet forming stream of fluid.

The high pressure printing system is sensitive for stable drop forming, in order to provide in a predictable manner droplets to be administered with respect to predetermined timing and placement positions. Conventionally, the printing head has a sensitivity with respect to varying printing pressures, which may be caused by the pressurizing system for providing the printing pressure. It has been found that conventional pressure systems provide unacceptable variations of printing pressures, in particular, piston driven pressure systems. In addition, a variation of the viscosity of the printing fluid may also cause drop variations that are disadvantageous.

SUMMARY OF THE INVENTION

According to an aspect of the invention, these problems are addressed. To this end, according to an aspect of the invention, a high pressure printing system is provided according to the features of claim 1. In particular, the high pressure printing system comprises: a high pressure printing head, constructed and arranged for printing a printing fluid with a printing pressure in at least a part of a channel upstream of the printing head in an interval of 10-3000 bars; a pressure system comprising a printing fluid inlet and a plurality of pressure cylinders constructed and arranged for providing a constant flow of said printing fluid, the pressure cylinders being interconnected by at least a pressure valve; and a damper, connected between an outlet of the pressure system and said high pressure printing head, provided for damping the valve action of the pressure valve.

BRIEF DESCRIPTION OF THE DRAWINGS

Other features and advantages will be apparent from the description, in conjunction with the annexed drawings, wherein.

DETAILED DESCRIPTION OF THE DRAWINGS

Figure 1:
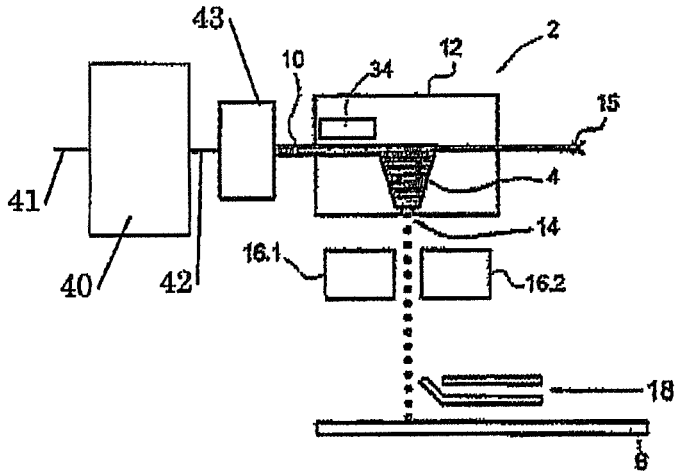
FIG. 1 shows schematically an embodiment of a high pressure printing head.

FIG. 1 shows schematically a high pressure printing apparatus 2 for printing a fluid material 4 on a plate- or sheet-shaped substrate 6 by means of a continuous jet printing technique. The apparatus 2 comprises a high pressure printing head 12, constructed and arranged for printing a printing fluid with a printing pressure in at least a part of a channel upstream of the printing head in an interval of 15-3000 bars. In addition, a pressure system 40 is provided comprising a printing fluid inlet 41 and an outlet channel 42.

The outlet channel 42 of the pressure system 40 connects with a damper 43. The outlet of the damper 43 is connected to the printhead 12 via channel 10. The channel in the printhead 12 is provided with at least one outflow opening, nozzle 14 through which the fluid material 4 exits under pressure in the form of a jet breaking up into drops, in order for these drops, after being selectively deflected, or directed, to be printed on the substrate 6. A transverse dimension of the outflow opening 14 can be in the interval of 15-300 micron.

In this example, the channel 10 comprises a portion downstream of the outflow opening 14 which is provided with a cock 15. By opening the cock 15, the printhead 12 can be flushed with a flushing material/flushing ink which is present in the channel.

The illustrated apparatus 2 is a printer of the continuous jet-type, whereby a continuous stream of drops to be printed is formed. However, the invention may be also applicable in a drop-on-demand type printer system where drops are delivered through the outflow opening only if the printhead has been activated to that effect. For the purpose of forming a jet breaking up into drops, the apparatus 2 is provided with a pressure regulating mechanism for varying the pressure of the material 4 upstream of the outflow opening.

The apparatus 2 in this example is provided with a directing system 16.1, 16.2 enabling the drops to be deflected in two directions for determining the print location of the drops on the material 6. To that end, the directing system 16.1, 16.2 is provided, for instance, with a charge electrode by means of which the drops can be provided with an electric charge. Also, the directing system 16.1, 16.2 may be provided with, for instance, a capacitor by means of which electrically charged drops can be deflected in their path. Further, the apparatus 2 may be provided with a collecting gutter 18 by which particular drops can be captured, so that these drops are not printed on the substrate 6.

The pressure generating means 40 is constructed for providing a printing pressure in an interval of 15-3000 bars. Accordingly, high-viscous materials 4, for instance in a range of 300-800 mPa·s are passed under a predetermined pressure through the channel in the direction of the outflow opening 14. Under this pressure, viscous fluid 4 accommodated in the reservoir is forced through the channel 10 to the outflow opening 14 in the printhead 12. Next, the viscous fluid 4 is forced through the outflow opening 14 to the substrate 6.

The apparatus 2 according to FIG. 1 is preferably provided with a heating element 34 for adjusting the viscous fluid 4 to a desired temperature. By adjusting the temperature of the viscous fluid 4, the viscosity of the fluid can (to some extent) be (additionally) regulated. The heating element may be included in the printhead 12 in or near the channel 10.

Figure 2:
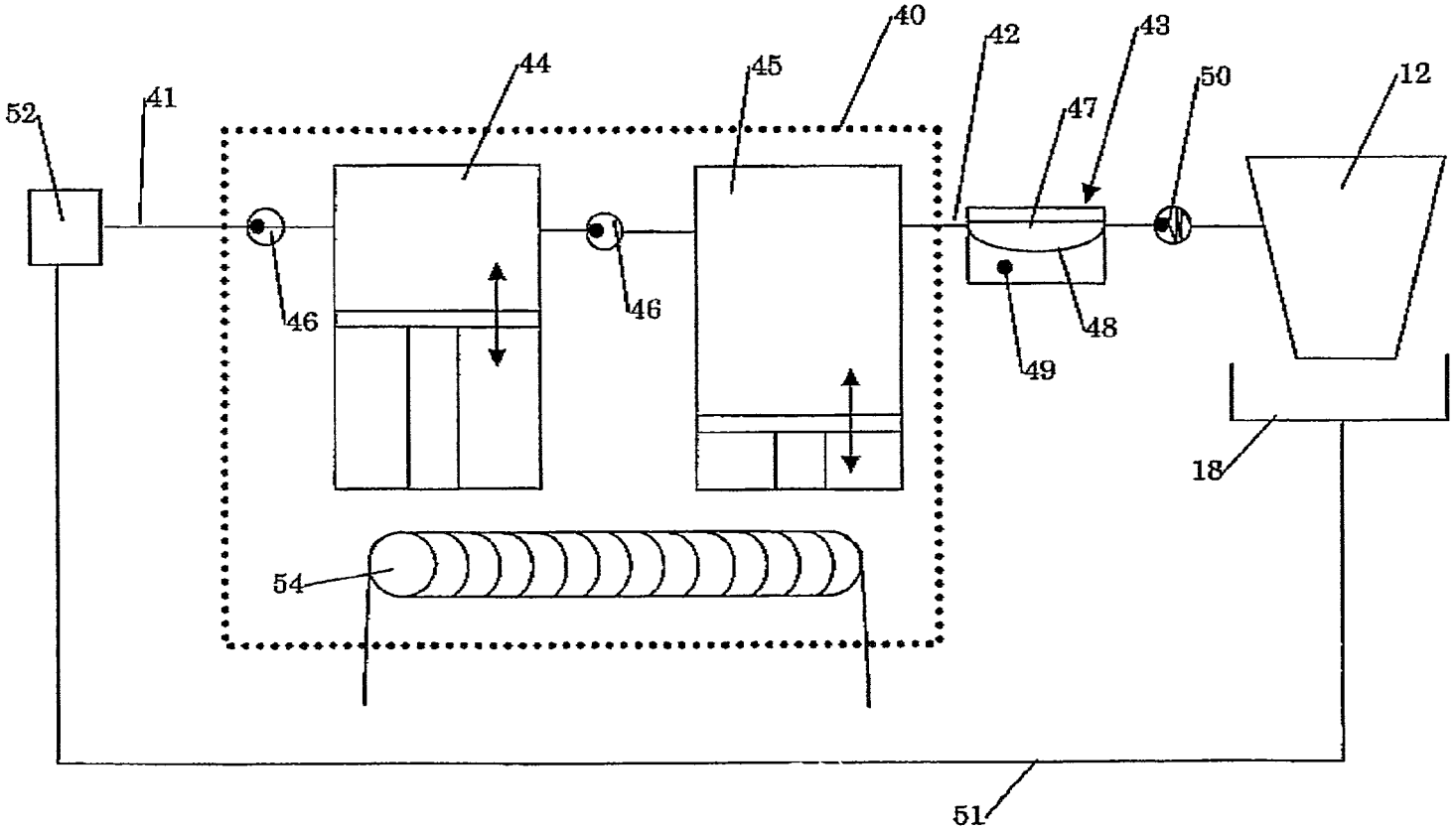
FIG. 2 shows schematically an embodiment of A high pressure printing system comprising: according to the invention.

FIG. 2 shows a detailed view of the pressure system 40 in conjunction with the damper 43 depicted in FIG. 1. Typically, the pressure system 40 comprises a plurality of pressure cylinders 44, 45. The pressure cylinders 44, 45 are controlled to work in a coordinated manner for providing a constant flow of said printing fluid 4. Such a pressure system 40 is conventionally known as a HPLC (High Pressure Liquid Chromatography) pump, used for chromatography purposes. In this system 41, the pressure cylinders 44, 45 are interconnected by at least an equalizing pressure valve 46. The valve 46 functions to equalize a pressure in both cylinders, that is, when a pressure in cylinder 44 is higher than in cylinder 45, the pressure will be equalized by opening the equalizing pressure valve 46. A similar valve 46 is also present in the inlet 41. In doing so, a generally constant fluid flow is provided, however, the pressure system 40 will generate a small ripple on a generated pressure value, which may propagate through the system and which can prevent a stable drop forming of the printing fluid in the printing head 12. To prevent propagation of the ripple, the damper 43 is connected between an outlet of the pressure system 40 and said high pressure printing head 12, provided for damping the valve action of the pressure valve 46. In a particular useful embodiment, the damper is a fluid, with a working pressure in a range above 50 bar. Such a fluid damper is useful in the relevant high pressure printing pressure ranges and typically comprises a guiding channel 47 having a wall 48 reinforced by a highly pressurized liquid 49 that absorbs pressure variations. However, due to the printing head 12 and dimensioning and viscosity of the printing fluid 4, the printing pressure may drop considerably out of the range of the damper 43, which thereby may loose an adequate damping power. Therefore, preferably, in combination with the damper 43 an overpressure valve 50 is provided, which separates an upstream pressure regime in the pressure system from a downstream pressure regime in the printing head 12 and which brings the pressure of damper 43 in a useful working range. Typically, the overpressure valve is activated by a pressure in a range of 50-600 bar, for instance, 600 bar. Thus, by the overpressure valve, the damper is brought in a useful working range, while the pressure downstream can be any value, dependent on the viscosity and geometric properties. Using this configuration, a constant flow system can be provided where a flow of printing fluid is generated substantially independent of pressure variations in the downstream pressure regime of the printing head 12.

In addition to the features described hereabove, preferably, a recirculation circuit 51 is provided for capturing printed printing fluid 4 and recirculating the captured fluid to the pressure system 40. Thus the 18 collecting gutter is connected to piping that is communicatively coupled to a recirculation pump 52. Since the printing fluid is of a highly viscous material, preferably, a recirculation pump outlet 53 is connected directly to the printing fluid inlet of pressure system with a very short and low impedance connection, to prevent cavitation in the pressure system 40. This recirculation pump 52 hence functions as a booster to provide an initial pressure to the pressure system 40 to more efficiently pump the viscous material and prevent cavitation or some other energy impeding effect. Of course, the booster system can also be provided without recirculating the printing fluid. In addition, the pressure system (or another relevant part in the flow circuit towards the printing head 12) may be provided with a temperature regulator, in particular, a heater 54, to provide a constant temperature, in particular, that is elevated above room-temperature. Accordingly the viscosity of the printing fluid can be influenced better, in particular, printing materials can be liquefied to a desired viscosity. Temperature of interest may be in a range 15° C.-360° C.; in particular, a range of 18° C.-150°.

It will be clear from the foregoing that the predetermined pressure which is hydraulically and/or pneumatically applied to the fluid material 4 in the channel, having a viscosity of 150 $10^{-3}$ Pa·s upon exit and at printing temperature, can be between 15 and 600 bars. It is also possible, however, that the predetermined pressure is between 100 and 3000 bars. In that case, when using an average nozzle size, a material having a viscosity of 150 $10^{-3}$ Pa·s upon exit and at printing temperature can be printed continuously with an apparatus according to the invention. It is also possible that the predetermined pressure is between 200 and 3000 bars. In that case, when using an average nozzle size, a material having a viscosity of 300-400 mPa·s upon exit and at printing temperature can be printed continuously with an apparatus according to the invention. Furthermore, it is possible that the predetermined pressure is between 300 and 3000 bars. This permits, using an average nozzle size, the continuous printing of a material having a viscosity of 500-600 $10^{-3}$ Pa·s upon exit and at printing temperature. Also, the predetermined pressure may be between 400 and 3000 bars for continuously printing, using an average nozzle size, for instance a material having a viscosity of 700-800 $10^{-3}$ Pa·s upon exit and at printing temperature.

The invention has been described on the basis of an exemplary embodiment, but is not in any way limited to this embodiment. Diverse variations also falling within the scope of the invention are possible.

The invention claimed is:

1. A high pressure printing system comprising:

a high pressure printing head, constructed and arranged for printing a printing fluid with a printing pressure in at least a part of a channel upstream of the printing head in an interval of 10-3000 bars;

a pressure system comprising a printing fluid inlet and a plurality of pressure cylinders constructed and arranged for providing a constant flow of said printing fluid, the pressure cylinders being interconnected by at least a pressure valve functioning as an equalizing pressure valve arranged to equalize a pressure in the pressure cylinders when a pressure in an upstream cylinder of the pressure cylinders is higher than a pressure in a downstream cylinder of the pressure cylinders; and a damper, connected between an outlet of the pressure system and said high pressure printing head, provided for damping a valve action of the equalizing pressure valve;

wherein the damper has a working pressure regime higher than the printing pressure; and wherein the high pressure printing system further comprises an overpressure valve arranged upstream of the printing head and downstream of the damper, an inlet of the overpressure valve being connected to an outlet of the damper and an outlet of the overpressure valve being connected to the channel upstream of the print head so as to provide the printing fluid to the print head, the overpressure valve operating at an activation pressure for providing a pressure regime upstream of the overpressure valve at least at the activation pressure in the working pressure regime of the damper.

2. A high pressure printing system according to claim 1, wherein the damper is a fluid damper, with a working pressure in a range above 50 bar.

3. A high pressure printing system according to claim 1 wherein the overpressure valve is activated by a pressure in a range of 300-3000 bar.

4. An apparatus according to claim 1, wherein the printing pressure is a pressure between 50 and 3000 bars.

5. An apparatus according to claim 4, wherein the printing pressure is a pressure between 200 and 3000 bars.

6. An apparatus according to claim 5, wherein the printing pressure is a pressure between 300 and 3000 bars.

7. An apparatus according to claim 6, wherein the printing pressure is a pressure between 400 and 3000 bars.

8. An apparatus according to claim 1, further comprising a recirculation circuit for capturing printed printing fluid and recirculating the captured printing fluid to the pressure system.

9. An apparatus according to claim1, further comprising a boosting system that is connected directly to the printing fluid inlet of the pressure system.

10. An apparatus according to claim 1, wherein said pressure system comprises a temperature controller to provide a temperature controlled printing fluid.

* * * * *